US009609952B2

(12) United States Patent
Horn

(10) Patent No.: US 9,609,952 B2
(45) Date of Patent: Apr. 4, 2017

(54) CHAIR, ESPECIALLY, OFFICE CHAIR

(71) Applicant: ITOKI CORPORATION, Osaka-shi, Osaka (JP)

(72) Inventor: Peter Horn, Dresden (DE)

(73) Assignee: ITOKI CORPORATION, Osaka-shi, Osaka (JP)

( * ) Notice: Subject to any disclaimer, the term of this patent is extended or adjusted under 35 U.S.C. 154(b) by 0 days.

(21) Appl. No.: 14/398,551

(22) PCT Filed: Apr. 25, 2013

(86) PCT No.: PCT/EP2013/001241
§ 371 (c)(1),
(2) Date: Nov. 3, 2014

(87) PCT Pub. No.: WO2013/164078
PCT Pub. Date: Nov. 7, 2013

(65) Prior Publication Data

US 2015/0091353 A1 Apr. 2, 2015

(30) Foreign Application Priority Data

May 4, 2012 (DE) ..... 10 2012 207 467

(51) Int. Cl.
*A47C 7/44* (2006.01)
*A47C 7/46* (2006.01)
(Continued)

(52) U.S. Cl.
CPC ..... *A47C 7/44* (2013.01); *A47C 1/024* (2013.01); *A47C 1/032* (2013.01); *A47C 3/00* (2013.01); *A47C 7/46* (2013.01)

(58) Field of Classification Search
CPC ..... A47C 7/44; A47C 1/024; A47C 1/032; A47C 3/00; A47C 7/46
See application file for complete search history.

(56) References Cited

U.S. PATENT DOCUMENTS 3,215,468 A * 11/1965 Swenson ..... A47C 7/445 297/284.1
3,233,885 A * 2/1966 Propst ..... A47B 96/202 267/153
(Continued)

FOREIGN PATENT DOCUMENTS

CN 1981671 A 6/2007
EP 0591933 A1 4/1994
(Continued)

OTHER PUBLICATIONS

Office Action dated Feb. 26, 2016 from corresponding Chinese patent application No. 201380023494.9 (with attached English-language translation).
(Continued)

*Primary Examiner* — David R Dunn
*Assistant Examiner* — Tania Abraham
(74) *Attorney, Agent, or Firm* — Drinker Biddle & Reath LLP

(57) ABSTRACT

A chair, especially an office chair, includes a seat that is fastened on a base support unit, a backrest that includes a back lower region and an upper shoulder region and is fastened to a back support, the back support being supported by the base support unit in a manner permitting rotation about an inclination axis. The shoulder region is connected to the back support in a manner permitting inclination about a shoulder axis and is hinge-connected to a back lower region at a lumbar region, and the back lower region further extends along a chair element so that when the shoulder region is inclined about the shoulder axis, an angle of the shoulder region relative to the back lower region is changed.

16 Claims, 4 Drawing Sheets

(51) Int. Cl.

| | |
|---|---|
| ***A47C 1/024*** | (2006.01) |
| ***A47C 3/00*** | (2006.01) |
| ***A47C 1/032*** | (2006.01) |

(56) References Cited

U.S. PATENT DOCUMENTS

| | | | | | |
|---|---|---|---|---|---|
| 3,565,482 | A * | 2/1971 | Blodee | A47C 7/14 | 297/284.3 |
| 4,157,203 | A * | 6/1979 | Ambasz | A47C 7/441 | 297/285 |
| 4,660,887 | A * | 4/1987 | Fleming | A47C 7/022 | 297/448.2 |
| 4,679,848 | A * | 7/1987 | Spierings | A47C 7/425 | 297/230.14 |
| 4,685,730 | A | 8/1987 | Linguanotto | | |
| 4,703,974 | A * | 11/1987 | Brauning | A47C 7/004 | 248/188.7 |
| 4,848,837 | A * | 7/1989 | Volkle | A47C 1/031 | 297/300.1 |
| 4,856,846 | A | 8/1989 | Lohmeyer | | |
| 4,981,326 | A * | 1/1991 | Heidmann | A47C 3/026 | 297/285 |
| 5,145,234 | A * | 9/1992 | Gualtierotti | A47C 7/425 | 297/440.16 |
| 5,575,095 | A | 11/1996 | Korn | | |
| 5,649,739 | A * | 7/1997 | Zapf | A47C 7/405 | 297/284.4 |
| 5,887,946 | A * | 3/1999 | Raftery | A47C 7/445 | 297/297 |
| 5,938,284 | A * | 8/1999 | Coffield | A47C 7/46 | 297/284.1 |
| 6,257,665 | B1 * | 7/2001 | Nagamitsu | A47C 7/405 | 297/285 |
| 6,626,497 | B2 * | 9/2003 | Nagamitsu | A47C 7/40 | 297/452.15 |
| 6,739,663 | B2 * | 5/2004 | Gevaert | A47C 7/445 | 297/296 |
| 6,938,956 | B1 * | 9/2005 | Piretti | A47C 7/38 | 297/230.14 |
| 7,014,269 | B2 * | 3/2006 | Coffield | A47C 1/03255 | 297/440.2 |
| 7,032,971 | B2 * | 4/2006 | Williams | A47C 7/405 | 297/284.4 |
| 7,568,765 | B2 * | 8/2009 | Brauning | A47C 7/38 | 297/354.1 |
| 7,775,601 | B2 * | 8/2010 | Wu | A47C 7/462 | 297/230.14 |
| 7,862,120 | B2 * | 1/2011 | Ueda | A47C 1/03255 | 297/285 |
| 8,128,175 | B2 * | 3/2012 | Groelsma | A47C 7/40 | 297/440.15 |
| 8,408,647 | B2 * | 4/2013 | Wu | A47C 7/402 | 297/285 |
| 8,613,481 | B2 * | 12/2013 | Parker | A47C 1/023 | 297/284.3 |
| 2005/0029849 | A1 | 2/2005 | Goetz et al. | | |
| 2007/0057550 | A1 * | 3/2007 | Beyer | A47C 7/462 | 297/284.4 |
| 2008/0084102 | A1 | 4/2008 | Link | | |
| 2011/0233979 | A1 | 9/2011 | An | | |
| 2011/0304183 | A1 * | 12/2011 | van Hekken | A47C 3/12 | 297/313 |

FOREIGN PATENT DOCUMENTS

| | | | |
|---|---|---|---|
| EP | 2 100 539 | A1 | 9/2009 |
| EP | 2 173 218 | B1 | 1/2011 |
| GB | 2 354 433 | A | 3/2001 |
| JP | S59-050353 | U | 4/1984 |
| JP | H01-139752 | U | 9/1989 |
| JP | H2-102836 | U | 8/1990 |
| JP | 2004-049658 | A | 2/2004 |
| JP | 2006-231088 | A | 9/2006 |
| JP | 2006-246990 | A | 9/2006 |
| JP | 2008-532625 | A | 8/2008 |
| JP | 2010-505507 | A | 2/2010 |

OTHER PUBLICATIONS

Office Action dated Nov. 11, 2015 from corresponding Japanese patent application No. 2015-509326 (with attached English-language translation).

Office Action dated Feb. 17, 2016 from corresponding Japanese patent application No. 2015-509326 (with attached English-language translation).

* cited by examiner

CHAIR, ESPECIALLY, OFFICE CHAIR

TECHNICAL FIELD

The present invention relates to a chair, especially an office chair, having the features described in the first paragraph of claim 1.

BACKGROUND ART

A chair of this kind can be known, for example, from EP2173218B1.

In general, office chairs of newest kinds have a so-called synchronous mechanism in which correlative movement of a seat and a backrest at the time of inclination of the backrest is generated such that a seat rear region also can be inclined simultaneously to the inclination of the backrest.

The synchronous mechanism is usually integrated in a support unit (referred to as a base support unit, here) on the seat lower side. The support unit is usually fastened on the support arm and connected to a pillar therethrough. Basically, synchronous mechanisms of various configurations are known. Further, a mechanism having an automatic weight adjustment function is also known in which a restoring force acting on the backrest is automatically adjusted in accordance with the actual body weight of a user of the present time. An example of an office chair having such a synchronous mechanism and an automatic weight adjustment function is known in EP2173218B1 described above.

SUMMARY OF INVENTION

Technical Problem

Starting from here, the present invention is based on a problem of providing a chair of this kind having especially a synchronous mechanism and hence providing a far higher comfort.

Solution to Problem

According to the invention, the problem is resolved by a chair having the features described in claim 1.

According to this, a chair, especially an office chair, includes: a seat fastened on a base support unit; and a backrest including a back lower region and an upper shoulder region and fastened to a back support. In particular, the back support is formed in an approximate J-shape and supported by the base support unit in a manner permitting rotation about an inclination axis. The base support unit itself also supports preferably a synchronous mechanism, as well as a seat support containing a cushion for forming the seat. Further, in the shoulder region, one side is hinge-connected to the back support and the other side is hinge-connected to the back lower region. The shoulder region can be inclined here about a shoulder axis. In this sense, a first hinge joint is formed between the shoulder region and the back support. The hinge connection to the shoulder region of the back lower region is achieved in a lumbar region of the backrest. Thus, the shoulder region and the back lower region are fastened to each other through a second hinge joint about an axis (referred to as a lumbar axis, hereinafter) running in an approximately transverse direction. At last, the back lower region further extends along one chair element, preferably, along the back support or the seat.

The back lower region is forcedly guided at the lower end of connection to the hinge joint between the shoulder region and the back lower region so that the shoulder region can rotate about the shoulder axis. This achieves mechanically forced guide. Specifically, this operation is achieved such that when the shoulder region is inclined about the shoulder axis, the azimuthal angle of the shoulder region relative to the back lower region is changed, in particular, the lumbar region of the backrest is warped frontward, that is, toward the seat (the shoulder region is inclined about the shoulder axis from the upright position toward a position of leaning rearward). Simultaneously, the back lower region is guided at a lower joint point of the seat side or the back support side. Thus, the joint connection and the guide availability at the lower end of the back lower region are respectively useful in length correction especially at the time of inclination of the backrest about the shoulder axis. In its entirety, this forced guide allows the lumbar region of the backrest to protrude frontward. This improves the comfort of the chair in its entirety.

In a more advanced mode for achieving the object, the backrest includes a center region and side regions sharing boundaries with this on both sides, which are oriented frontward, that is, toward the seat so as to effectively serve as side guides. In the more advanced mode for achieving the object, the orientation of the side regions relative to the center region is forcedly changed simultaneously at the time of inclination of the shoulder region about the shoulder axis. Specifically, this change is achieved such that when the shoulder region is inclined rearward, the side regions are inclined approximately frontward so as to more effectively serve as side guides. That is, in its entirety, synchronous forced movement is performed such that at the same time that the lumbar portion of the body is supported, the side regions are guided frontward for the purpose of more effective guiding.

For the purpose of enabling frontward rotation of the side regions, the side regions can rotate about a perpendicular axis with facing the center region in a method for achieving the object. Thus, the backrest itself includes, along the side surface thereof, a region inclined, or at least bent, frontward through a hinge joint oriented in a perpendicular direction. Thus, in the backrest itself, in addition to a typical horizontal hinge type joint between the shoulder region and the back lower region, substantially perpendicular two hinge type joints are also formed between each center region and the side region. These hinge type joints may be formed by elastic (bending) regions or alternatively by hinges.

In a more advanced mode for achieving the object, further, the back lower region is hinge-connected to the seat. By virtue of the direct connection of the backrest and the seat, in a transitional region between the seat and the backrest, the body can be more satisfactorily guided over the entire inclined position.

For the purpose of achieving the object, here, the seat includes a seat rear part fastened to a seat front part by a hinge method. Here, both seat parts are mutually supported through a suitable hinge joint such as to become rotatable about one axis (referred to as a seat axis, hereinafter). By virtue of this hinge type connection in which one side of the seat rear part is connected to the seat front part and the other side is connected to the back lower region, length correction at the time of inclination of the shoulder region about the shoulder axis is achieved by a simple method, that is, by a method that the back lower region is pulled upward toward the shoulder axis. Thus, by virtue of this operation, when the shoulder region is inclined rearward, the seat rear part is pulled upward through the back lower region so that the body can be supported even in a transitional region between the seat and the backrest.

The configuration that the seat rear part is supported in a freely rotatable manner improves simultaneously the comfort even when the entire backrest is inclined about the inclination axis, that is, even when the back support is inclined rearward about the inclination axis on the base support side. Even at the time of this movement, effective forced guide for the seat rear region is performed. Here, both seat parts are usually fabricated from a plate or a shell, that is, from a seat support unit having excellent mechanical rigidity. Then, a seat cushion is placed thereon.

In view of as high comfort as possible, the seat axis is oriented to the rearward of the inclination axis, that is, toward the backrest. Further, the seat axis, and/or preferably the inclination axis also, are arranged near the body rotation axis limited especially by the hip joints. By virtue of this, the relative deviation between the backrest or the seat and the body at the time of inclination is suppressed to the minimum.

In a more advanced mode for achieving the object, an additional back upper region is continuous to the shoulder region and useful for supporting the head. Thus, this region may be referred to as a head region. This back region is also connected to the shoulder region. Then, in the mode for achieving the object, this connection is also of hinge type. Here, in an additional implementation variation, the back upper region also includes a region capable of rotating in a transverse direction. Then, similarly, this region also is connected to additional side regions. By virtue of this, forced guide is achieved in its entirety so that the side regions are forcedly inclined frontward.

The shoulder region is arranged such that inclination about the shoulder axis performed against the restoring force acting on the back support is allowed. This may be fabricated preferably from a spring element or may be realized by a spring-elastic structure of the hinge joint between the back support and the shoulder region. Preferably, for example, between the back support and the backrests, a spring element is arranged that applies a restoring force to the shoulder region. Here, for example, the spring element is formed as an elastic element and a (pressure) spring stretched between the back support and the backrest or formed as an integrated form in the hinge joint. The restoring force can be adjusted such as to achieve the object.

According to a first preferable implementation variation, the backrest is fabricated from a frame upholstered therearound with cloth such as mesh cloth. Then, the shoulder region includes a frame side upper part and the back lower region includes a frame side lower part. Here, the frame both parts are connected to each other by a hinge method. Here, preferably, the frame upper part and the frame lower part are arranged with an angle relative to each other, specifically, with an angle such that the frame protrudes frontward toward the seat in the lumbar region and hence, in particular, in the region of hinge joint between the upper shoulder region of the backrest and the back lower region. The hinge joint and hence the lumbar axis are formed within the limits of this protrusion. Usually, these frame side parts are formed—in rear view—in a shape of protruding outward with an angle also in a transverse direction.

The frame further includes especially a lower crossbar and an upper crossbar which are bent. Here, preferably, the upper crossbar is connected to the back support by a hinge method so that a hinge joint between the shoulder region and the back support is formed through this connection.

Here, further, the crossbars are respectively connected by a hinge method to the frame upper part and the frame lower part for achieving the object, specifically, in particular, such that rotation is allowed about the perpendicular axis described already. By virtue of the hinge type connection of the crossbars, a possibility is obtained that at the time of inclination of the shoulder region, the frame side part rotates inward and rotates outward anew at the time of reverse movement. This series of movement is achieved forcedly by an enforcing force acting on the frame at the time of inclination adjustment. This causes, on one side, a situation that the frame side parts are bent relative to each other so that the lumbar region protrudes frontward. At the same time, this causes a situation that the frame both parts rotate inward with facing the crossbars and hence rotate together inward toward the center region. By virtue of this, desired support in the lumbar region is achieved. Further, supplementary side support is achieved in the side regions.

In particular, the frame is formed in a shape merely going along the peripheral edge and hence does not include additional support members for supporting the body. Supporting of the body is mainly achieved in the cloth upholstered portion. The crossbars, especially the upper crossbar, are warped rearward and hence do not satisfactorily support the body.

However, at the same time, in order to ensure that the lumbar is reliably supported mechanically in the lumbar region, a lumbar support connected to the lower crossbar is arranged supplementarily. Here, preferably, the lumbar support is connected in a non-rotatable manner and hence automatically follows the movement of the crossbar. Since necessary length correction is performed when the lumbar region is bent frontward, usually, twist occurs automatically in the frame side lower part. Then, since the crossbar is connected to this portion mechanically in an immovable manner, the azimuthal angle of the frame lower part is transmitted to the lumbar support through the lower crossbar.

In order to form the hinge joint for the purpose of realizing fabrication of the hinge joint between the individual frame members, that is, between the frame side both parts and between these and the crossbars, into a form as simple as possible from the perspective of structure, a notch is preferably fabricated in the frame. The frame is a frame of one-piece form in its entirety and is formed, for example, as a plastic frame fabricated by cast molding or injection molding. Thus, the frame is fabricated such that a limited region has an excellent bending elasticity owing to the reduction in the amount of material.

In a more advanced preferable mode, a backrest upper part for supporting the head is further formed supplementarily in the shoulder region and is limited by an auxiliary upper frame. Preferably, the upper frame also is fabricated in a form of one piece together with the remaining frames. The upper frame receives the upper crossbar. Then, the frame side part is continuous to the frame side part of the shoulder region, specifically, in particular, to a hinge joint limited through the perpendicular axis.

According to a second preferable implementation variation, the backrest includes: a plurality of back elements fastened to each other in a freely rotatable manner, that is, at least one main back element for limiting the shoulder region; and a lower back element fastened by a hinge method to a lower end of the main back element and forming a back lower region. Here, each back element is fabricated in a plate shape or a shell shape or, alternatively, includes such a shaped material. Thus, in this implementation variation, the backrest is formed in a mosaic form constructed from a plurality of connected plate-shaped back elements. In order to form a side region, preferably, side-part elements (wangenelement) on the side are fastened by a hinge method individually to the main back element and the lower back element. These are also fabricated each in a plate or a shell or, alternatively, includes such a shaped material and then similarly arranged to each other by a hinge method. Thus, at the time of inclination, forced guide and forced movement are performed such that the side-part elements (wangenelement) on the side protrude frontward about the shoulder axis.

Preferably, in order to supplementarily support the head, an upper back element is formed in the center region and, more preferably, additional side-part elements (wangenelement) are formed. Then, these are connected to the upper back element by a hinge method and, at the same time, connected also to the side-part elements (wangenelement) of the shoulder region by a hinge method.

Here, in order to realize desired forced guide by a method as simple as possible, each back element is formed by a wedge shape or a trapezoidal shape. Then, mutually adjacent back elements are arranged such as to support each other in an advantageous manner. Thus, both the shoulder region and the back lower region are individually fabricated preferably from three separate back elements formed in a trapezoidal shape such as to support each other. At the same time, mutually adjacent trapezoidal elements also are similarly supported by each other between the shoulder region and the back lower region. Thus, the arrangement is such that the longer side and the shorter side are facing each other. Here, in particular, the construction of the trapezoid is selected such that the center region between the side-part elements (wangenelement) has a narrow width in the lumbar region. At the same time, the cheek-shaped element has a wide width in this region.

Here, the mutually adjacent edges of the back elements individually limit the hinge joint. Since the structure is of approximately trapezoidal or wedge shape, the perpendicular axis does not run in an exactly perpendicular direction between the central back element and the side-part element (wangenelement). Thus, the perpendicular axis mentioned here should be recognized as the axis oriented merely in an approximately perpendicular direction and having a possible deviation of ±30% or the like from the exactly perpendicular direction. This holds also for both implementation variations described above.

The individual back elements are connected by a hinge method to each other by a film hinge method at sides or edges sharing a boundary with each other by a method for achieving the object. In addition, in a preferable mode, the back elements are formed as individual separate plates or shells according to the first implementation variation. Then, these are connected to each other by a planar elastic hinge strip composed of fiber cloth, a rubber elastic sheet, or the like. Alternatively, an elastic cover (a cover with cushion) of large area, in particular, covering the entire back element surface is employed. Here, in case of the cushion cover, a pocket may be sewn on and then each plate-shaped back element may be inserted therein.

Alternatively, the plurality of back elements, in particular, the entire backrest, are formed by a plastic component of one-piece form (e.g., an injection-molded product). The individual back elements are connected to each other through material bridges, that is, divided from each other by a notch or a material taper attached to the one-piece component. At the same time, this notch limits the hinge joint formed by a film hinge method. The plastic backrest of one-piece form is usually covered by a cushion cover.

BRIEF DESCRIPTION OF DRAWINGS

Embodiments of the present invention are described below in detail with reference to the drawings. The contents of the drawings are as follows.

In the figures, components having an identical function are designated by an identical reference numeral.

DESCRIPTION OF EMBODIMENTS

Figure 1:
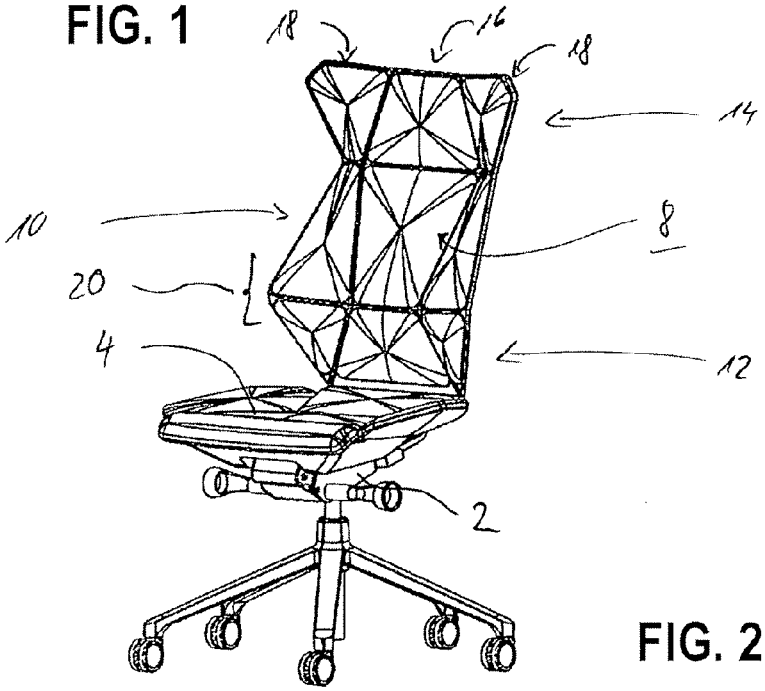
FIG. 1 is a perspective front view of an office chair according to a first implementation variation.
Figure 2:
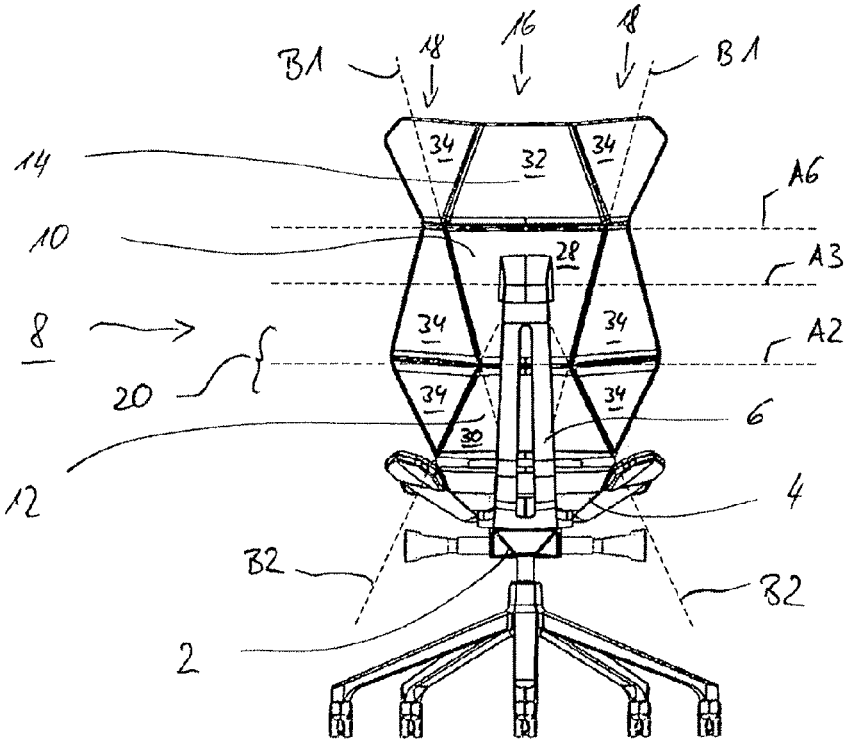
FIG. 2 is a rear view of an office chair shown in FIG. 1.

In each of both implementation variations, an office swivel chair shown in the figure includes abase support unit 2, to which a seat 4 and a back support 6 are fastened. The back support 6 is supported (befestigen ist) by the base support unit 2 in a manner permitting rotation about an inclination axis A1. The base support unit 2 receives a synchronous mechanism not shown in detail in the figure here. This includes also a mechanism for weight adjustment. This may be formed as an automatic weight adjustment device or, alternatively, may be formed as an important adjustment device of manual adjustment type.

A backrest 8 divided into a plurality of partial regions is fastened to the back support 6. Thus, this includes an upper shoulder region 10 and a back lower region 12. Further, continuously to the shoulder region 10, a back upper region 14 for forming a head region is further provided in both embodiments.

In its entirety, the backrest 8 includes a center region 16, which is continuous to side regions 18 individually in a transverse direction.

The shoulder region 10 and the back lower region 12 share a boundary with each other in a lumbar region 20 and are fastened to each other through a hinge joint by a hinge method. Thus, these can be inclined relative to each other about a common axis (referred to as a lumbar axis A2, hereinafter) so that the relative azimuthal angle can be changed.

The shoulder region 10 also is connected to the back support 6 by a hinge method through an additional hinge joint for allowing the shoulder region 10 to be inclined about a horizontal axis (referred to as a shoulder axis A3, hereinafter). Supplementarily, perpendicular axes in a transverse direction running substantially perpendicularly, that is, upper perpendicular axes B2, are formed in the shoulder region 10. Further, lower perpendicular axes B2 are formed in the back lower region 12. The perpendicular axes B1 and B2 allow the side regions 18 to perform inward rotation in a frontward direction toward the seat 4.

In both embodiments, the backrest 8 is mechanically connected directly to the seat 4. Thus, in addition to indirect connection through the back support 6 and the base support unit 2, direct connection is formed between the backrest 8 and the seat 4. Further, the seat 4 includes a plate-shaped seat rear part 22 mechanically connected to the back lower region 12. This connection is achieved especially through a hinge joint and at least one to-a-certain-extent rotational movement about a connection axis A4 is allowed. The seat rear part 22 itself is fastened through an additional hinge joint to a seat front part 24 such that rotation about a seat axis A5 is allowed. Here, both seat parts 22 and 24 are fabricated in plate shapes or shell shapes and, in particular, form a seat support of two-piece form so as to finally support a cushion.

A spring element 26 (see FIGS. 3 and 4) acting between the back support 6 and the backrest 8 applies a restoring force to the shoulder region 10 so that inclination adjustment about the shoulder axis A3 is allowed for the shoulder region 10.

In the embodiment shown in FIGS. 1 to 4, the backrest 8 forms a plurality of back elements of plate shape or shell shape, that is: a main back element 28 for forming a center region of the shoulder region 10; a lower back element 30 for forming a center part of the back lower region 12; and an upper back element 32 for forming a center part of the back upper region 14. These three back elements 28, 30, and 32 are respectively connected to each other through hinge joints running horizontally. The main back element 28 and the lower back element 30 are connected to each other by a hinge method through the lumbar axis A2. The upper back element 32 is connected to the main back element 28 in a manner permitting inclination about head axis A6 together with the main back element 28.

Each of these back elements 28 to 32 is continuous to a side-part element (wangenelement) 34 on the side and is connected to each adjacent side-part element (wangenelement) 34 by a hinge method. As seen especially from the side views of FIGS. 3 and 4, the side-part element (wangenelement) 34 extends frontward from the side toward the seat 4 and then is oriented at an angle toward the back elements 28 to 32 of the center region 16.

Each of the back elements 28 to 34 has a basic surface of trapezoidal shape, wedge shape, or triangular shape and extends from the longer side toward the shorter side in a narrow width manner or a tapering manner. The individual back elements 28 to 34 are arranged such as to support (befestigen) each other. Thus, mutually adjacent—when viewed from a perpendicular direction—back elements 28 to 34 are in contact with each other on the longer-side side or the shorter-side side. By virtue of this, a waist is formed in the lumbar region 20. At the same time, here, the side-part element (wangenelement) 34 is pulled frontward from the side.

Operation of the chair according to the first implementation variation shown in FIGS. 1 to 4 is as follows.

When the shoulder region 10 is inclined rearward (mainly) about the shoulder axis A3, since this is hinge-connected to the back lower region 12, the back lower region 12 is pulled approximately upward and, at the same time, protrudes also frontward toward the seat 6 so that desired support is achieved in the lumbar region 20. At the same time, by virtue of the mechanical connection between the side-part elements (wangenelemente) 34 and further by virtue of the special trapezoidal shape of each of the back elements 28 to 34, the side-part elements (wangenelemente) 34 are bent frontward toward the seat. Thus, the upper part of the body is held satisfactorily and further the sides of the body are also guided satisfactorily. Since the backrest 8 protrudes frontward in the lumbar region 20, length correction is necessary within the limits of the back lower region 12.

This is achieved by the hinge connection of the back lower region 12 with the seat rear part 22 and the hinge connection with the seat front part 24. When the shoulder region 10 is inclined rearward, in the seat rear part 22, the region of connection with the back lower region 12, that is, the region of connection axis A4 is pulled upward in an approximately perpendicular direction. At the same time, the seat rear part 22 performs rotational movement with facing the seat front part 24. Thus, once the shoulder region 10 is inclined about the shoulder axis A3, the seat rear part 22 is moved obliquely upward. Here, in general, the shoulder axis A3 is formed in an approximately upper one-third portion of the shoulder region.

Figure 3:
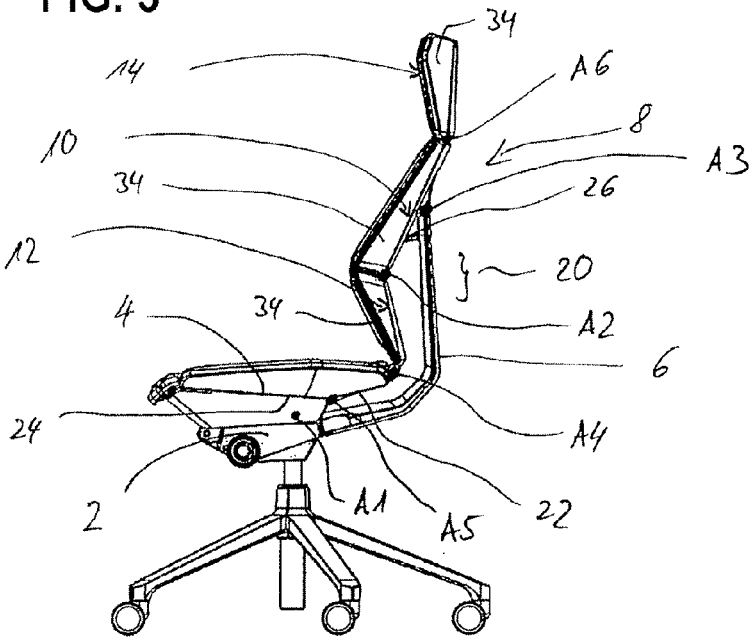
FIG. 3 is a side view of an office chair shown in FIG. 1 in a state that a backrest is at a standard upright position.
Figure 4:
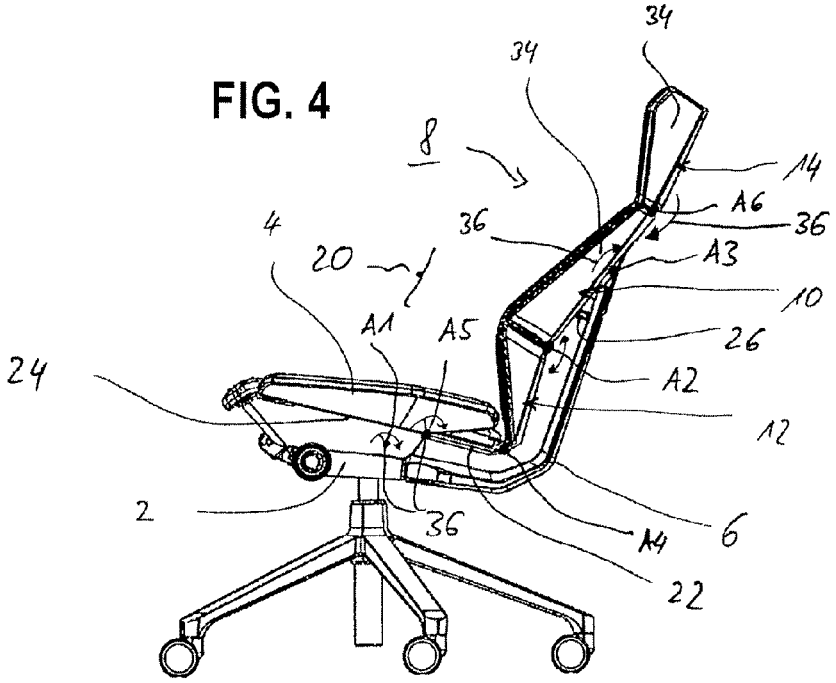
FIG. 4 is a side view of an office chair shown in FIG. 1 in a state that a backrest is inclined.

Usually, inclination adjustment of the shoulder region 10 is achieved at the time that the entire backrest 8 is inclined with facing the base support unit 2, that is, at the time that the back support 6 is inclined about the inclination axis A1. The situation of such complex inclination is shown in FIG. 4 in comparison with FIG. 3. With starting at the initial position that the back support 6 is at the basic upright position as shown in FIG. 3, when inclination adjustment is to be performed, the individual elements perform rotating motion about the individual axes A1 to A6 as indicated by arrows 36 in FIG. 4.

By virtue of the inclination of the backrest 8 about the inclination axis A1, the shoulder region 10 is pulled obliquely rearward along the shoulder axis A3. As a result, the backrest is elongated in comparison with the initial situation shown in FIG. 3. That is, the shoulder region 10 is inclined frontward toward the seat 4 about the shoulder axis A3 so that the angle between the shoulder region and the back lower region 12 becomes large. Thus, in its entirety, the seat rear part 22 is pulled downward toward the back support 6. The angle between the seat rear part 22 and the back lower region 12 which is approximately the right angle in the initial situation shown in FIG. 3 becomes slightly smaller.

Thus, in its entirety, what is formed by the individual axes A1 to A6 is a hinge chain or a link chain, which causes the contour of the backrest 8 to fit forcedly to the desired shape at the time of inclination adjustment.

By virtue of the elongation of the backrest, that is, when the lumbar region 20 is shifted rearward toward the back support 6, at the same time, forced correction is caused in side regions 8. As a result, the individual side-part elements (wangenelemente) 34 are bent frontward about the perpendicular axes B1 and B2 and, supplementarily, also bent frontward about a third perpendicular axis B3 in the back upper region 14.

When the backrest 8 is to return to the upright position, the movement is performed in the reverse sequence. Here, the spring force of the spring element 26 is oriented such as to be against the elongation movement at the time that the backrest 8 transits from the upright position to the inclined position shown in FIG. 4.

Also in a second embodiment shown in FIGS. 5 to 8, the operation is basically the same. Thus, what is formed here is also a hinge chain or a link chain for guiding forcedly the contour of the backrest at the time of inclination so as to forcedly achieve fitting. Anyway, the back elements 28 to 34 formed separately are absent here. Instead, the backrest 8 is constructed from one frame 38, that is, a frame 38 constructed from: a frame lower part 40 of the back lower region 12; a frame upper part 42 of the shoulder region 10; a lower crossbar 44; and an upper crossbar 46. In the present embodiment, the upper crossbar 46 simultaneously forms the lower crossbar of the head frame 48 within the limits of the back upper region 14. The head frame 48 includes side parts 50 facing each other and continuous to the frame upper part 42; and an upper crossbar 52 located yet above. In particular, the upper crossbar 46 and the upper crossbar 52 located yet above are each fabricated in a form warped rearward here. Since, the frame parts 40 and 42 are arranged with an angle relative to each other—when viewed from a transverse direction—, the lumbar region 20 is warped frontward.

In its entirety, the frame 38 is upholstered with cloth 54. In order to form the lumbar axis A2, a notch, that is, a material taper 56 is added to the frame 38. In order to form both perpendicular axes B1 and B2, suitable notches 56 in a perpendicular direction are added to a transitional region from the frame upper part 42 to the upper crossbar 46 and added to a transitional region from the frame lower part 40 to the lower crossbar 44.

The upper crossbar 46 is connected to an edge on the front side of the back support 6 and then rotational movement between the upper crossbar 46 and the back support 6 is allowed at this connection site. By virtue of this, the shoulder axis A3 is limited.

Figure 8:
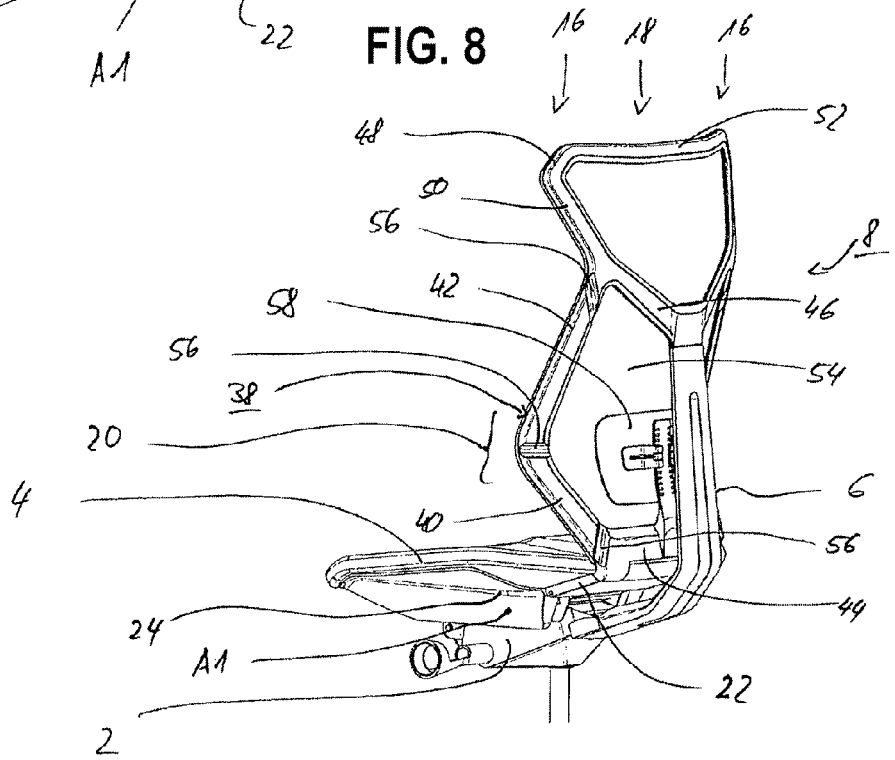
FIG. 8 is a perspective side view of an improvement implementation variation of an office chair in which an auxiliary lumbar support is arranged supplementarily to the implementation variation shown in FIG. 5.

In the implementation variation of FIG. 8, further, supplementarily, a lumbar support 58 is arranged that is connected through a holding web to the lower crossbar 44 in a non-rotatable manner.

Figure 5:
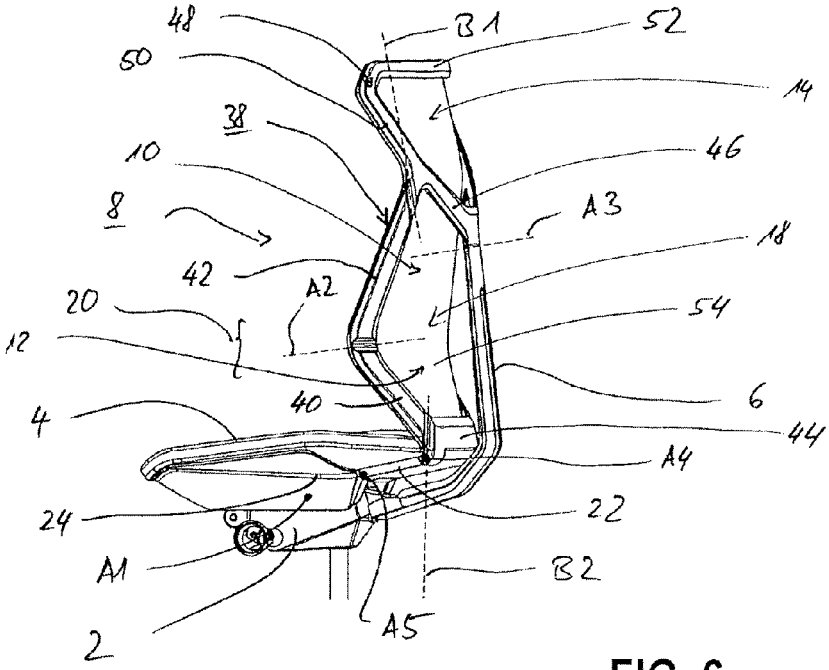
FIG. 5 is a perspective side view of a cut-out part of an office chair according to a second implementation variation.
Figure 6:
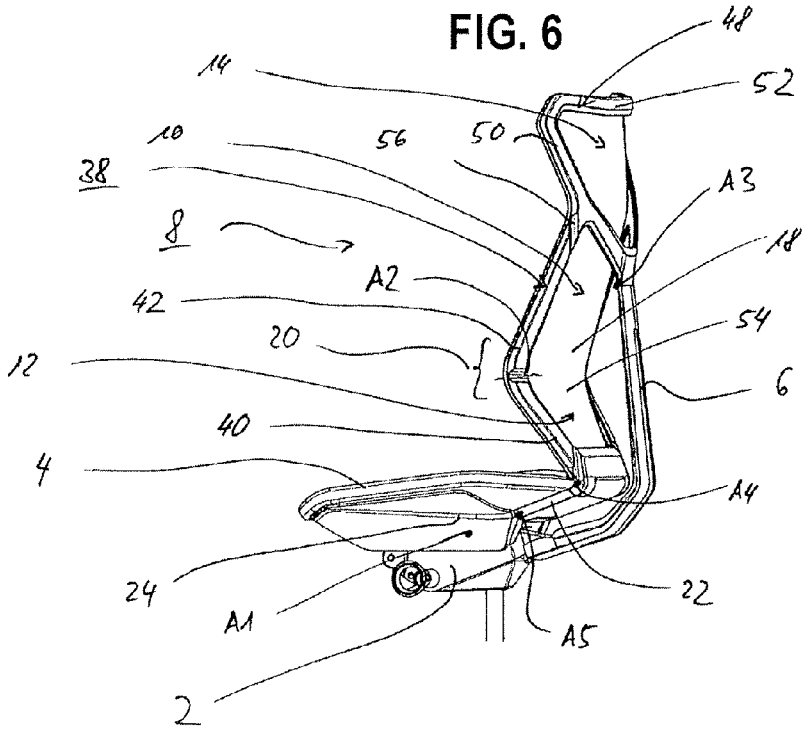
FIG. 6 is a perspective side view of an office chair shown in FIG. 5 in a state that the shoulder region alone of the backrest is slightly inclined rearward.

FIG. 5 shows the initial position of no-load condition in which the backrest 8 stands upright. FIG. 6 shows a position that with starting at the no-load initial position, the shoulder region 10 is inclined mainly about the shoulder axis A3 (no inclination about the inclination axis A1). That is, the head frame 48 has first been inclined frontward and then the head frame 48 has been inclined rearward anew so as to be located at an approximately upright position at present. Thus, in its entirety, the cloth 54 is slightly pulled upward. Necessary length correction is achieved when the seat rear part 22 is pulled upward about the seat axis A5. At the same time, here, the angular position between the seat rear part 22 and the back lower region 12 preferably elastically held by each other about the connection axis A4 can be changed. In the present embodiment, at the time of this movement from the position shown in FIG. 5 to the position shown in FIG. 6, no change occurs in the angular position between both frame parts 40 and 42. That is, rotation about the lumbar axis A2 is not yet performed.

Figure 7:
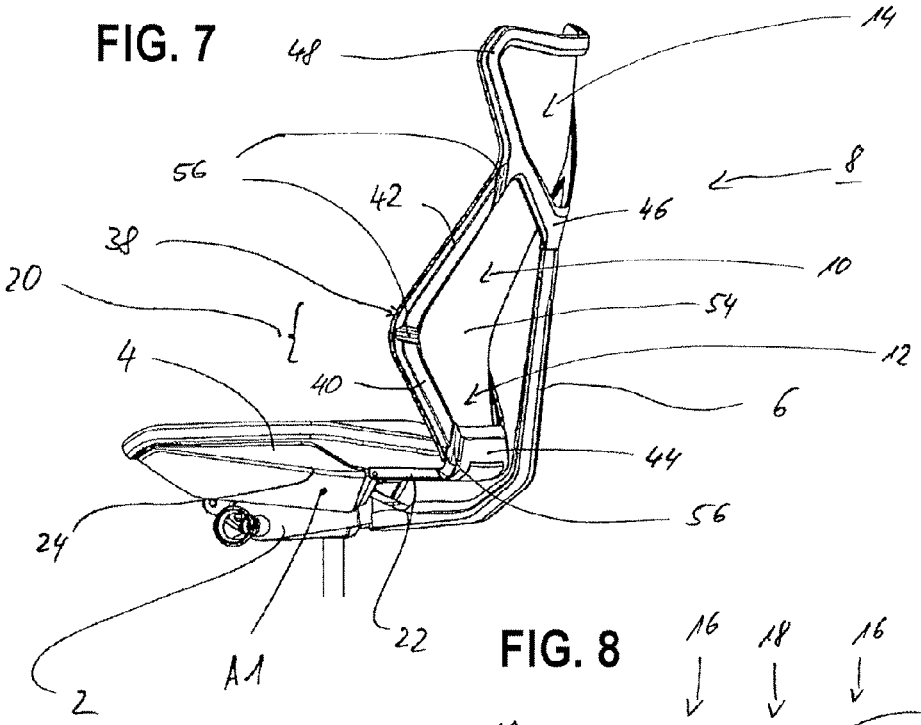
FIG. 7 is a perspective side view of an office chair shown in FIG. 5 in a state that in comparison with the situation shown in FIG. 5, a backrest in its entirety is inclined rearward about an inclination axis so that a shoulder region of the backrest is supplementarily inclined rearward about a shoulder axis.

FIG. 7 shows a multi-functional and complex inclination adjustment in which at last, the shoulder region 10—shown in FIG. 6—is inclined rearward about the shoulder axis A3 and, at the same time, the entirety of the backrest 8 also is inclined rearward about the inclination axis A1. Similarly to the first implementation variation shown in FIG. 4, also here, the backrest 8 is elongated downward and then the seat rear part 22 rotates downward in comparison with the initial situation shown in FIG. 5. At the same time, the shoulder region 10 is inclined rearward. By virtue of this elongation, in its entirety, the side frame parts 40 and 42 rotate inward about the perpendicular axes B1 and B2 so as to serve as side guides more effectively.

In the implementation variation shown in FIG. 8, supplementarily, the lumbar is supported (befestigen ist) by the additional lumbar support 58 in the lumbar region 20.

DESCRIPTION OF REFERENCE NUMERALS

2 Base support unit
4 Seat
6 Back support
8 Backrest
10 Upper shoulder region
12 Back lower region
14 Back upper region
16 Center region
18 Side region
20 Lumbar region
22 Seat rear part
24 Seat front part
26 Spring element
28 Main back element
30 Lower back element
32 Upper back element
34 Side-part element (wangenelement)
36 Arrow
38 Frame
40 Frame lower part
42 Frame upper part
44 Lower crossbar
46 Upper crossbar
48 Head frame
50 Side part
52 Additional crossbar
54 Cloth
56 Notch
58 Lumbar support
A1 Inclination axis
A2 Lumbar axis
A3 Shoulder axis
A4 Connection axis
A5 Seat axis
A6 Head axis
B1 Upper perpendicular axis
B2 Lower perpendicular axis

The invention claimed is:

1. A chair comprising:

a seat that is fastened on a base support unit; and a backrest that includes a back lower region and an upper shoulder region and is fastened to a back support, the back support being supported by the base support unit in a manner permitting rotation about an inclination axis, wherein the shoulder region is connected to the back support in a manner permitting inclination about a shoulder axis and is hinge-connected to the back lower region at a lumbar region, wherein the back lower region further extends along a chair element so that when the shoulder region is inclined about the shoulder axis, an angle of the shoulder region relative to the back lower region is changed, wherein the backrest includes a center region and a side region sharing a boundary with the center region and oriented frontward as a side guide, wherein when the shoulder region is inclined, the orientation of the side region relative to the center region is forcedly change, and wherein the side region is rotatable about a perpendicular axis toward the center region.

2. The chair according to claim 1, wherein the back lower region is hinge-connected to the seat.

3. The chair according to claim 1, wherein the seat includes a seat rear part hinge-fastened to a seat front part.

4. The chair according to claim 1, wherein the shoulder region is continuous to a back upper region for supporting the head and, in particular, the back upper region is hinge-connected to the shoulder region.

5. The chair according to claim 1, wherein a spring element for acting between the back support and the backrest is arranged and applies a restoring force to the shoulder region so as to allow hinge connection thereof to the back support.

6. The chair according to claim 1, wherein the backrest includes a frame upholstered therearound with cloth and the frame includes a frame upper part located in the shoulder region and a frame lower part located in the back lower region.

7. The chair according to claim 6, wherein the frame includes a lower crossbar and an upper crossbar and the upper crossbar is hinge-connected to the back support.

8. The chair according to claim 6, wherein the frame includes an upper crossbar and a lower crossbar, which are respectively hinge-connected to the frame upper part and the frame lower part, and wherein the hinge connection is such that when the shoulder region is inclined about the shoulder axis, frame side parts respectively rotate inward and outward.

9. The chair according to claim 6, wherein a lumbar support is arranged connected to a lower crossbar mechanically in a non-rotatable manner.

10. The chair according to claim 8, wherein the hinge connection is realized through a notch.

11. The chair according to claim 1, wherein the backrest includes a plurality of back elements fastened to each other in a freely rotatable manner, wherein the plurality of back elements includes at least a main back element for limiting the shoulder region and a lower back element hinge-fastened to a lower end of the main back element and forming the back lower region.

12. The chair according to claim 11, wherein side-part elements are respectively hinge-fastened in a side part to the main back element and the lower back element and the side-part elements are also hinge-fastened to each other.

13. The chair according to claim 11, wherein the back elements individually have a wedge-shaped surface or a trapezoidal surface and mutually adjacent back elements are supported by each other.

14. The chair according to claim 11, wherein the back elements are hinge-connected to each other by a film hinge method.

15. The chair according to claim 11, wherein the plurality of back elements are fabricated from a member of one-piece form, and wherein the individual back elements are connected to each other by a film hinge formed as a material bridge or, alternatively, the back elements are formed as plates of separate form and then connected to each other selectively either by an elastic hinge strip or by an elastic cover of large area, in particular, covering the entire surface of the back elements.

16. A chair comprising:

a seat that is fastened on a base support unit; and a backrest that includes a back lower region and an upper shoulder region and is fastened to a back support, the back support being supported by the base support unit in a manner permitting rotation about an inclination axis, wherein the shoulder region is connected to the back support in a manner permitting inclination about a shoulder axis and is hinge-connected to the back lower region at a lumbar region, wherein the back lower region further extends along a chair element so that when the shoulder region is inclined about the shoulder axis, an angle of the shoulder region relative to the back lower region is changed, wherein the backrest includes a frame upholstered therearound with cloth and the frame includes a frame upper part located in the shoulder region and a frame lower part located in the back lower region, and wherein the frame includes an upper crossbar and a lower crossbar, which are respectively hinge-connected to the frame upper part and the frame lower part, and wherein the hinge connection is such that when the shoulder region is inclined about the shoulder axis, frame side parts respectively rotate inward and outward.

* * * * *